US011512870B2

(12) United States Patent
Wright

(10) Patent No.: US 11,512,870 B2
(45) Date of Patent: Nov. 29, 2022

(54) CEILING REGISTER VENT WITH BOW-SPRINGS ON SIDEWALLS FOR SCREWLESS ATTACHMENT TO REGISTER BOX

(71) Applicant: The Wright Handyman Inc., Calgary (CA)

(72) Inventor: Colin M Wright, Calgary (CA)

(73) Assignee: The Wright Handyman Inc., Calgary (CA)

( * ) Notice: Subject to any disclaimer, the term of this patent is extended or adjusted under 35 U.S.C. 154(b) by 105 days.

(21) Appl. No.: 17/226,338

(22) Filed: Apr. 9, 2021

(65) Prior Publication Data

US 2022/0128262 A1 Apr. 28, 2022

(30) Foreign Application Priority Data

Oct. 27, 2020 (CA) ..... CA 3097159

(51) Int. Cl.
*F24F 13/08* (2006.01)

(52) U.S. Cl.
CPC ..... *F24F 13/084* (2013.01)

(58) Field of Classification Search
CPC ..... F24F 13/084; F24F 13/08; F24F 13/082; F24F 13/20
USPC ..... 454/248, 330–332
See application file for complete search history.

(56) References Cited

U.S. PATENT DOCUMENTS 3,366,031 A * 1/1968 Hedrick ..... F24F 13/082 454/332
5,015,917 A * 5/1991 Nigg ..... H01J 61/325 362/267

OTHER PUBLICATIONS

The Home Depot, "Speedi-Boot 4 in.×10 in.×5 in. 90 degree Register Vent Boot with Adj. Hangers for HVAC Duct Work", downloaded on Apr. 8, 2021 from https://www.homedepot.ca/product/speedi-boot-4-in-x-10-in-x-5-in-90-degree-register-vent-boot-with-adj-hangers-for-hvac-duct-work/1000737689.

* cited by examiner

*Primary Examiner* — Vivek K Shirsat
(74) *Attorney, Agent, or Firm* — ATMAC Patent Services Ltd.; Andrew T. MacMillan

(57) ABSTRACT

A vent register includes a front plate having a perforated section for allowing airflow through the front plate, and a plurality of sidewalls perpendicularly extending from a side of the front plate and forming a sleeve for insertion into an opening of a ventilation duct. A first bow-spring is attached to a first sidewall of the plurality of sidewalls and a second bow-spring is attached to a second sidewall, the second sidewall being opposite the first sidewall. The first and second bow-springs are each respectively spring-tempered wires, the first bow-spring being attached at both ends to the first sidewall and the second bow-spring being attached at both ends to the second sidewall. Each of the first and second bow-springs forms a U-shape wing respectively extending from the and second sidewalls. The bow-springs include friction increasing means on at least a center portion for securing the register vent in the opening.

17 Claims, 7 Drawing Sheets

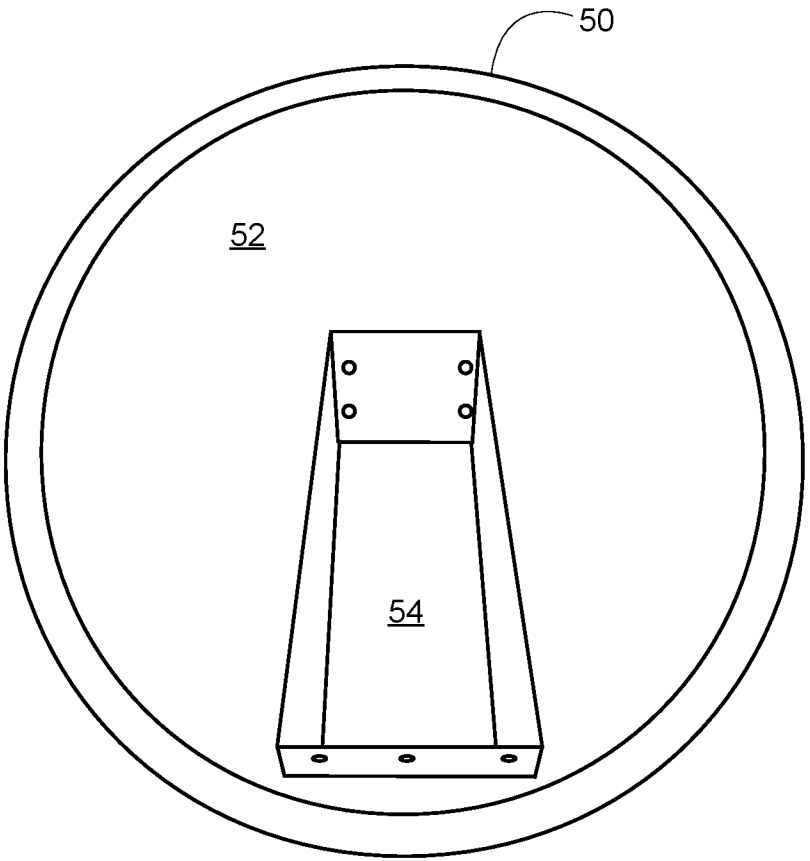
FIG. 6 – Prior art
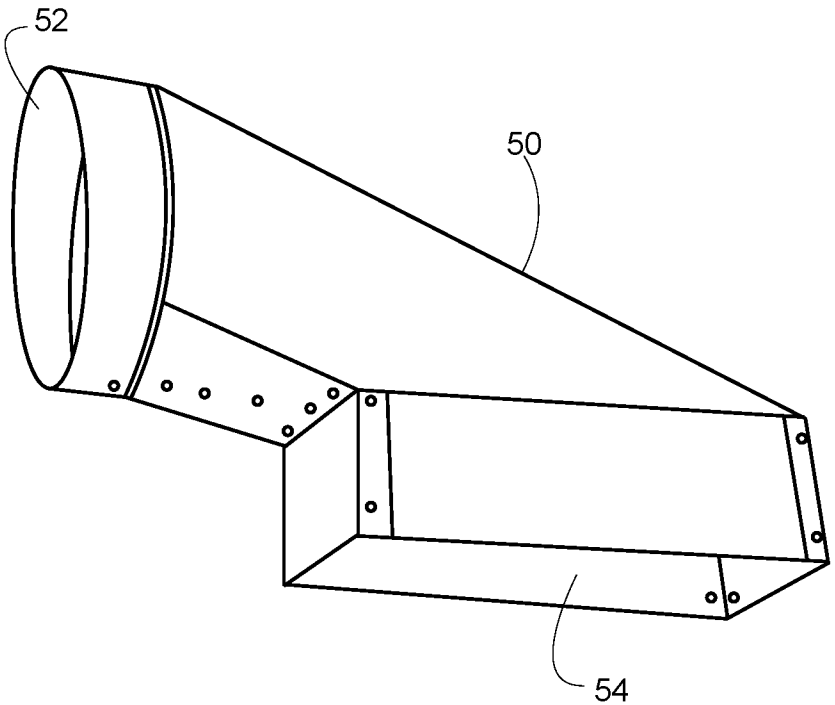
FIG. 5 – Prior art

CEILING REGISTER VENT WITH BOW-SPRINGS ON SIDEWALLS FOR SCREWLESS ATTACHMENT TO REGISTER BOX

This application claims the benefit of priority of Canadian Patent Application No. 3,097,159 filed Oct. 27, 2020, which is incorporated herein by reference.

BACKGROUND OF THE INVENTION

(1) Field of the Invention

The invention pertains generally to heating, ventilation, and air conditioning (HVAC) systems. More specifically, the invention relates to a register vent having integrated bow-springs on its sidewalls for screwless attachment to a register box or other ductwork opening.

(2) Description of the Related Art

Register vents for heating are difficult to properly secure in ceilings. A typical method known in the prior art is to utilize screws to secure the front plate of the register vent to the ceiling surface, but often the ceiling surface is drywall or similar material and screws do not hold well. Attempting to insert drywall anchors into the edge of a drywall cut is not helpful as the anchor itself does not secure well immediately adjacent the drywall edge.

Another known approach is to utilize magnets to hold the register vent in the register box; however, magnets utilized for this purpose are awkward to work with as they need to be secured to the register vent at a location that will put them in close proximity to a metal surface of the register box. Due to the irregular shapes of the ductwork and associated register boxes, upon insertion of the vent into the box, it is a common problem that the magnets are not close enough to the metal surfaces and do not hold well. The position of the magnets on the vent surface may need to be adjusted several times and further insertion attempts made. Furthermore, adhesive utilized to secure one or more magnets to the side of the register vent may fail after a period of time due to the heat from the hot air passing through the vent.

BRIEF SUMMARY OF THE INVENTION

According to an exemplary embodiment of the invention there is disclosed a vent register including a front plate having a perforated section for allowing airflow through the front plate, a plurality of sidewalls perpendicularly extending from a side of the front plate and forming a sleeve for insertion into an opening of a ventilation duct, and a first bow-spring attached to a first sidewall of the plurality of sidewalls. The first bow-spring is a length of spring-tempered wire attached at both ends to the first sidewall such that the first bow-spring forms a U-shape wing along the first sidewall.

In some embodiments, the vent register further includes a second bow-spring attached to a second sidewall of the plurality of sidewalls, the second sidewall being opposite the first sidewall. The second bow-spring is a second length of spring-tempered wire attached at both ends to the second sidewall such that the second bow-spring forms a second U-shape wing along the second sidewall A benefit of some embodiments of the invention is that the register vent is particularly well-suited for use in ceiling installations. The bow-spring(s) exert a force on the inner sidewalls of a register box opening and the friction of the bow-springs pushing against these surfaces overcomes the force of gravity and the force of airflow on the vent register. In this way, the vent register is held secure in position without utilizing screws. Damage to the ceiling drywall is prevented and visual appeal is increased as the vent register lacks screws. Beneficially, a user in the room cannot see what is holding the register in place.

These and other advantages and embodiments of the present invention will no doubt become apparent to those of ordinary skill in the art after reading the following detailed description of preferred embodiments illustrated in the various figures and drawings.

BRIEF DESCRIPTION OF THE DRAWINGS

The invention will be described in greater detail with reference to the accompanying drawings which represent preferred embodiments thereof:

FIG. 5 illustrates a perspective side view of a ceiling register box according to the prior art.

FIG. 6 illustrates a perspective end view of the register box of FIG. 5 as seen from the inside through the ductwork tubing according to the prior art.

FIG. 12 illustrates a zoomed-in top view of the point of connection labelled as area B in

FIG. 9.

FIG. 16 illustrates a zoomed-in top view of the point of connection labelled as area C in

FIG. 13.

DETAILED DESCRIPTION

Figure 1:
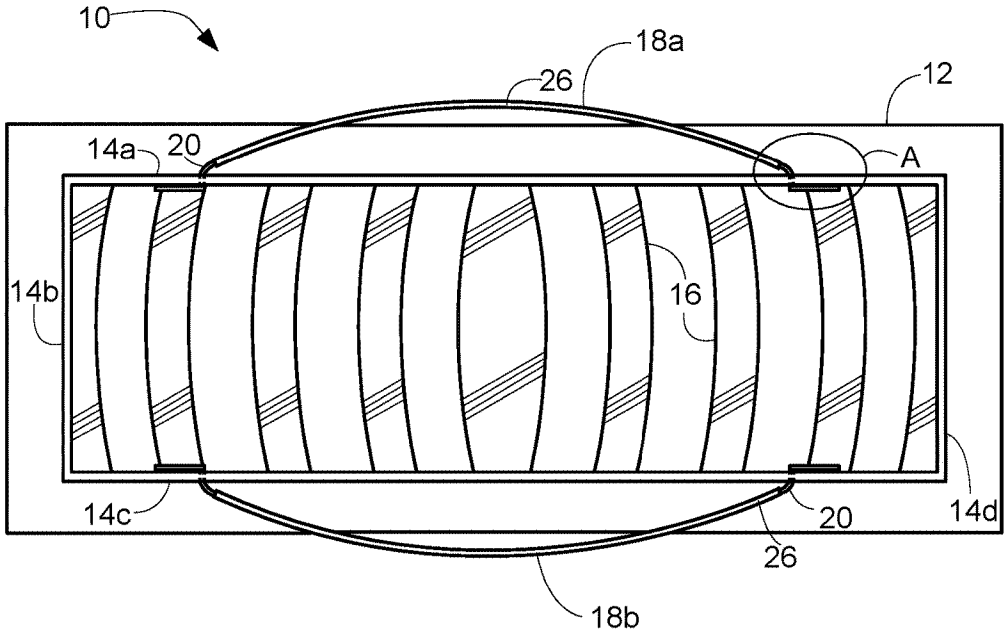
FIG. 1 shows a top view of a register vent with two bow-springs attached by plastic weld, orientated and ready for insertion into a ceiling-based register box according to an exemplary embodiment of the present invention.

FIG. 1 shows a top view of a register vent 10 orientated for insertion into a ceiling according to an exemplary embodiment of the present invention. The register vent 10 in this embodiment is substantially rectangular in shape and includes a front plate 12 and a plurality of four sidewalls 14*a,b,c,d* perpendicularly-extending from the front plate and forming a rectangular sleeve for insertion into a ventilation duct opening such as a register box opening in the ceiling. The front plate 12 is perforated in this embodiment by a grille 16 that may be swivelable for directing airflow, and the register vent 10 may further include a damper (not shown) for blocking airflow.

Extending laterally away from each of the longer length sidewalls 14*a,c* in this embodiment are U-shaped bow-spring wings 18*a,b*, each respectively formed by lengths of spring-tempered wire 20. The spring-tempered wire may be 20-gauge piano wire, also known as high-carbon steel wire. Commonly utilized for forming springs, the wire 20 holds its shape and bounces back to its original shape after bending, stretching, and twisting. In this embodiment, the register vent 10 includes first and second bow-springs 18*a,b*, each opposite one another on the longer sidewalls 14*a,c* of the rectangular shaped register 10.

Figure 3:
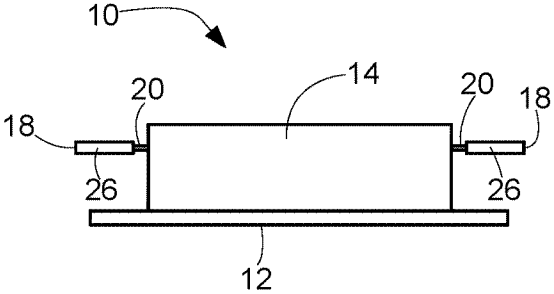
FIG. 3 illustrates an end view of the register vent of FIG. 1.
Figure 2:
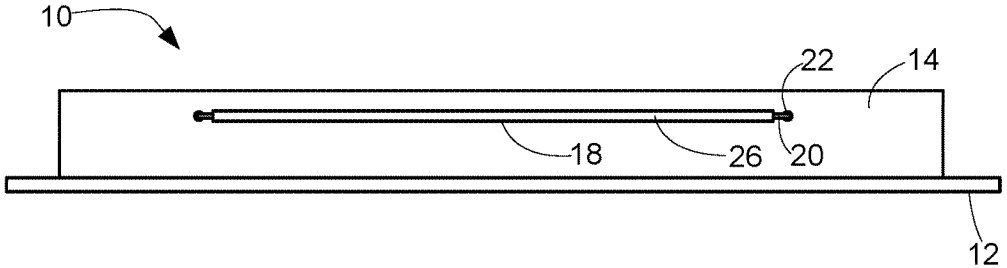
FIG. 2 illustrates a side view of the register vent of FIG. 1.

FIG. 2 illustrates a side view of the register vent 10 of FIG. 1, and FIG. 3 likewise illustrates an end view of the register vent 10 of FIG. 1.

Figure 4:
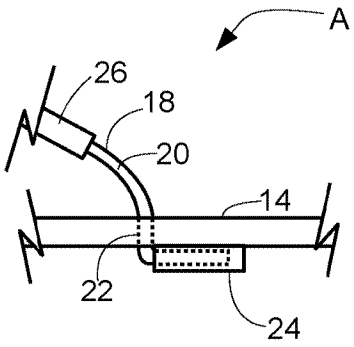
FIG. 4 illustrates a zoomed-in top view of the point of connection labelled as area Ain FIG. 1.

FIG. 4 illustrates a zoomed-in top view of the point of connection labelled as area Ain FIG. 1. Taking the end of one of the bow-spring 18 as an example, the wire 20 is attached to the first sidewall 14*a* by passing each end of the wire 20 through a hole 22 in the sidewall 14 and then utilizing a plastic weld 24 to secure the end of the wire 20 along an inner surface of the sidewall 14. Especially for polystyrene-based plastic sidewalls 14, the plastic weld 24 may be performed utilizing melted polystyrene to bond well with the sidewalls 14 and achieve a solid and long-term connection. In some embodiments, rather than adding additional polystyrene, the plastic weld 24 may be achieved by holding a plastic welder or other heating iron on the end of the wire 20 in order to heat the wire such that the wire melts into the sidewall 14, thus securing the wire 20 to the sidewall 14. In other embodiments, different types of connections including glues and other adhesives may be utilized. For other types of vent registers 10 having metal sidewalls 14, another embodiment is to weld the ends of the wire 20 to the sidewalls 14.

As illustrated in FIGS. 1 to 4, to increase the friction of the first and second bow-springs 18, each bow-spring 18 includes a rubberized plastic wrap 26 along a center portion of the wire 20 forming the bow-spring 18. In some embodiments, the rubberized plastic wrap 26 is a hollow heat-shrink tubing through which the wire 20 is passed prior to being heated in order to affix the heat-shrink tubing to the wire 20 and thereby form the rubberized plastic wrap 26. Other types of friction increasing means 26 that may be utilized in other embodiments include friction pads, liquid rubberized plastic, tapes, and other adhesives.

In an exemplary embodiment, register vent 10 is formed by the front plate 12 being eleven and a quarter inches long and four and quarter inches wide. The sidewalls 14 forming the perpendicularly-extending sleeve are ten inches long (sidewalls 14*a,c*) and three inches wide (sidewalls 14*b,d*). The first and second bow-springs 18 are attached to the each of the ten inch long sidewalls 14*a,c* approximately two inches from the ends of the sidewalls 14*b,d*. The bow-springs 18 are each formed by an eight inch length of 0.035 inch wire 20 that bows out laterally to a maximum distance at the center of the wire 20 of approximately one inch from the sidewall 14. The holes 20 in the sidewall 14 through which the wire 20 of the bow-springs 18 pass are about a quarter of an inch from the upper edge of the sidewalls 14.

FIG. 5 illustrates a perspective side view of a ceiling register box 50 according to the prior art, and FIG. 6 illustrates a perspective end view of the register box 50 of FIG. 5 as seen from the inside through the ductwork tubing 52. As illustrated, the register box 50 includes a ventilation duct opening 54 for passing warmed (or cooled) air into a room via a ceiling.

Figure 8:
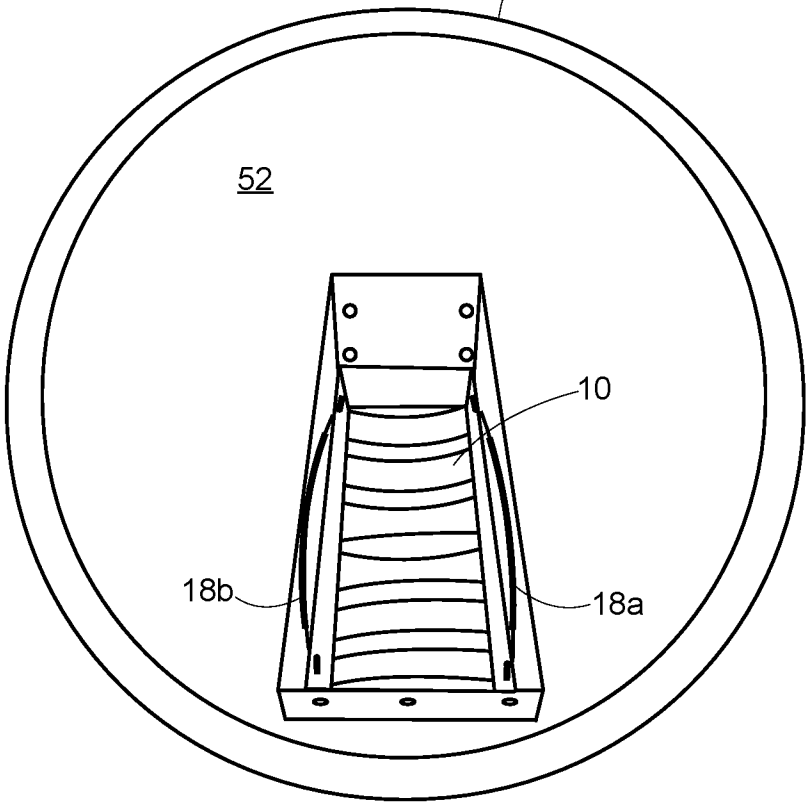
FIG. 8 illustrates a perspective end view of the register box of FIG. 5 with the register vent of FIG. 1 attached as seen from the inside through the ductwork tubing.
Figure 7:
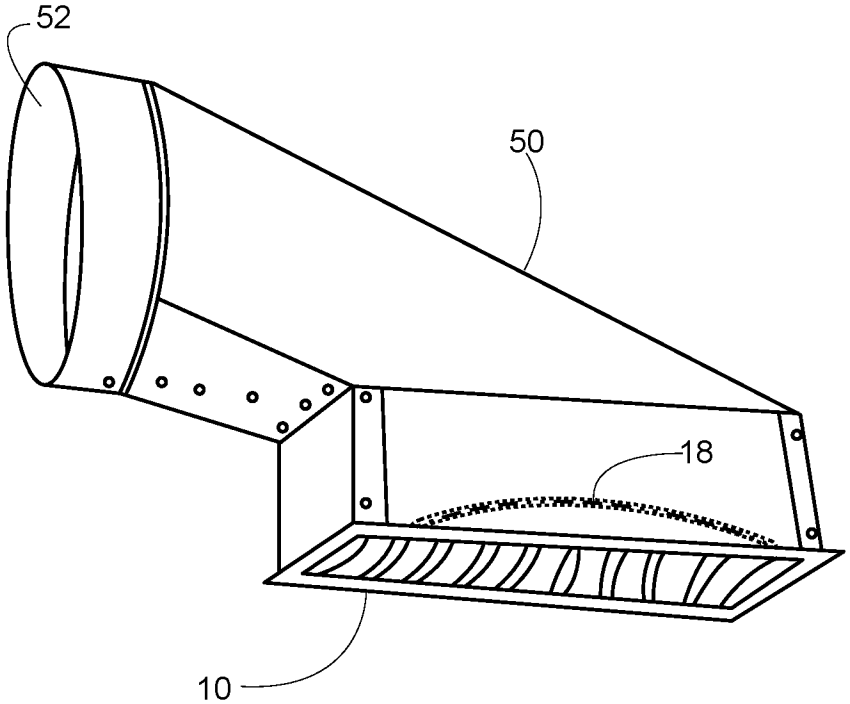
FIG. 7 illustrates a perspective side view of the ceiling register box of FIG. 5 having the register vent of FIG. 1 attached.

FIG. 7 illustrates a perspective side view of the ceiling register box 50 having the register vent 10 of FIG. 1 attached, and FIG. 8 illustrates a perspective end view of the register box 50 with register vent 10 attached of FIG. 7 as seen from the inside through the ductwork tubing 52.

As shown in FIG. 7, the dotted line represents the bow-spring wing 18 folded up on the inside of the register box 50. The spring-tempered wire 20 forming the bow-spring 18 resists this upwards folding and thus applies an outward force to the wire 20 that acts to push the bow-spring wing 18 against the inner surface of the register box 50. The combination of this outward-facing force by the spring-tempered wire 20 along with the friction of the rubberized plastic wraps 26 on the bow-springs 18 overcomes the force of gravity and also the additional force of airflow and holds the register vent 10 securely in place. The same action also occurs with the second bow-spring 18 on the other side of the register vent 50.

As shown in FIG. 8, the first and second bow-springs 18 are curved upwards on the inside of the register box 50 as a result of being folded upward into this position by a user when the register vent 10 is inserted into the register box opening 54. The spring force of the wire 20 forming the bow-spring wings 18 at this point is sufficient to push the friction increasing means (i.e., rubberized plastic wrap 26 in this embodiment) on the inner sidewalls 14 of the register box 50 and thereby hold the register vent 10 in position.

A method of installing the register vent 10 by a user according to an exemplary embodiment includes bending up a first of the bow-springs 18*a* and inserting that side of the register vent 10 first into the register box 50. The user then bends the other side bow-spring 18*b* upwards and pushes the register vent 10 upwards into the opening 54 of the register box 50. At this point, the friction force of the sidewall bow-spring wings 18 holds the register vent 10 in place and the user can let go.

Beneficially, no screws are needed to be utilized in this embodiment to hold the register vent 10 in place in the ceiling. Besides providing a more secure hold, the register vent 10 of this embodiment prevents damage to the ceiling drywall material and has clean aesthetic look as there is no need to drill out any screw holes on the in-room facing surface of the front plate 12. When viewed from below, it is not apparent how the register vent 10 is being held in place. Furthermore, if needed, such as for cleaning, the register vent 10 may also be easily removed by a user overcoming the friction force of the bow-spring wings 18 in order to pull the register vent 10 downward and out of the register box 50. Unlike screw-based attachment, repeated removal and insertion of the register vent 10 with integrated bow-springs 18 in this embodiment has no negative impact to the ceiling drywall.

Figure 11:
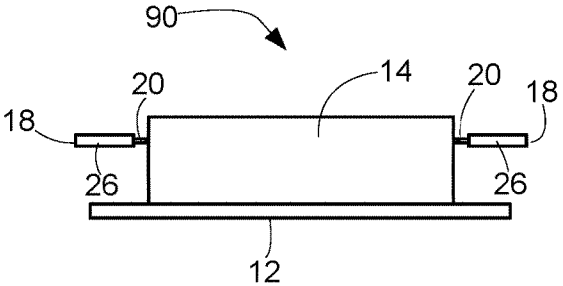
FIG. 11 likewise illustrates an end view of the register vent of FIG. 9.
Figure 9:
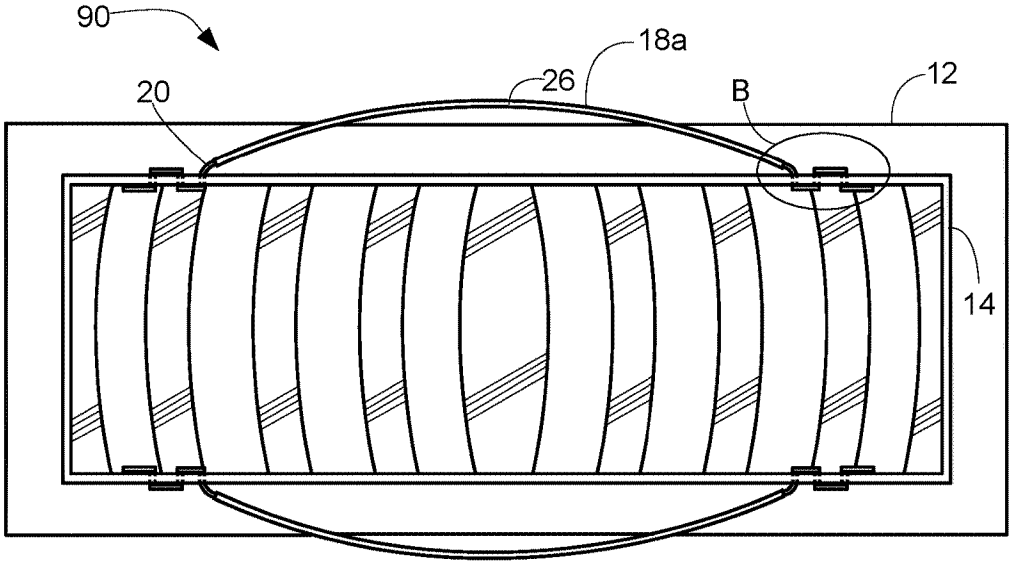
FIG. 9 shows a top view of a register vent having a stitched connection on the ends of the wire of a plurality of sidewall wings according to an exemplary embodiment of the present invention.
Figure 10:
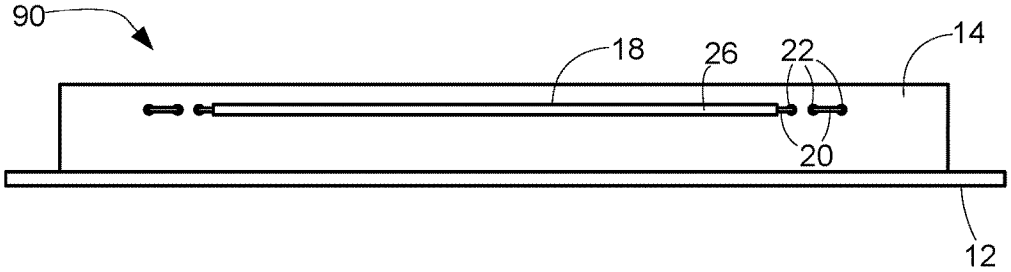
FIG. 10 illustrates a side view of the register vent of FIG. 9.

FIG. 9 shows a top view of a register vent 90 having a stitched connection on the ends of the wire 20 of a plurality of sidewall wings 18 according to an exemplary embodiment of the present invention. FIG. 10 illustrates a side view of the register vent 90 of FIG. 9 and FIG. 11 likewise illustrates an end view of the register vent 90 of FIG. 9. As shown, the wire 20 forming the first and second sidewalls 14 in this embodiment is stitched via a plurality of at least three holes 22*a,b,c* through the perpendicularly-extending sidewalls 14 on each end of the wire 20.

Figure 12:
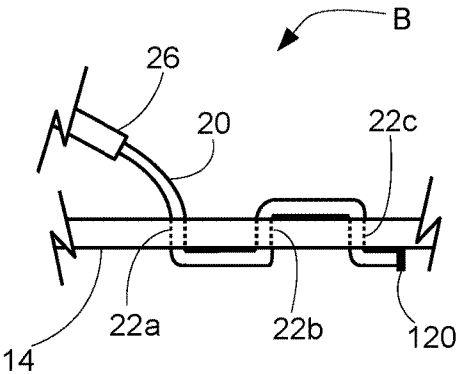

FIG. 12 illustrates a zoomed-in top view of the point of connection labelled as area B in FIG. 9. As illustrated, the spring-tempered wire 20 firstly passes through a first hole 22*a* in the sidewall 14 to enter an inside area of the sidewall sleeve 14. The wire 20 is then run a short distance such a quarter of an inch where it passes through second hole 22*b* to enter the outside area of the sidewall 14. The wire 20 is again run a short distance such as a quarter of an inch where it passes through a third hole 22*c* to re-enter the inside area. In some embodiments, a stopper 120 is attached to the end of the wire 20 at this point to prevent it from being pulled through the holes 22*a,b,c*. Likewise, in some embodiments, the end of the wire 20 is attached to the inner surface of the sidewall 14 such as via any of the previously-described techniques of plastic welding, glue or other adhesives.

The stitched connection of wire 20 in this embodiment is beneficial as an easy to manufacture device. A number of holes 22 such as three or more holes is generally sufficient to provide a secure connection on the ends of the wire 20 and multiple bow-springs can easily be added to a prior art register vent that does include bow-springs.

In some embodiments, the above-described register vents 10, 90 may be either plastic or metal-based register vents. However, metal register vents may beneficially be manufactured with further techniques to attach the bow-springs 18 to the sidewalls that are more suitable to metal-to-metal connections such as crimping in addition to the above-described techniques.

Figure 13:
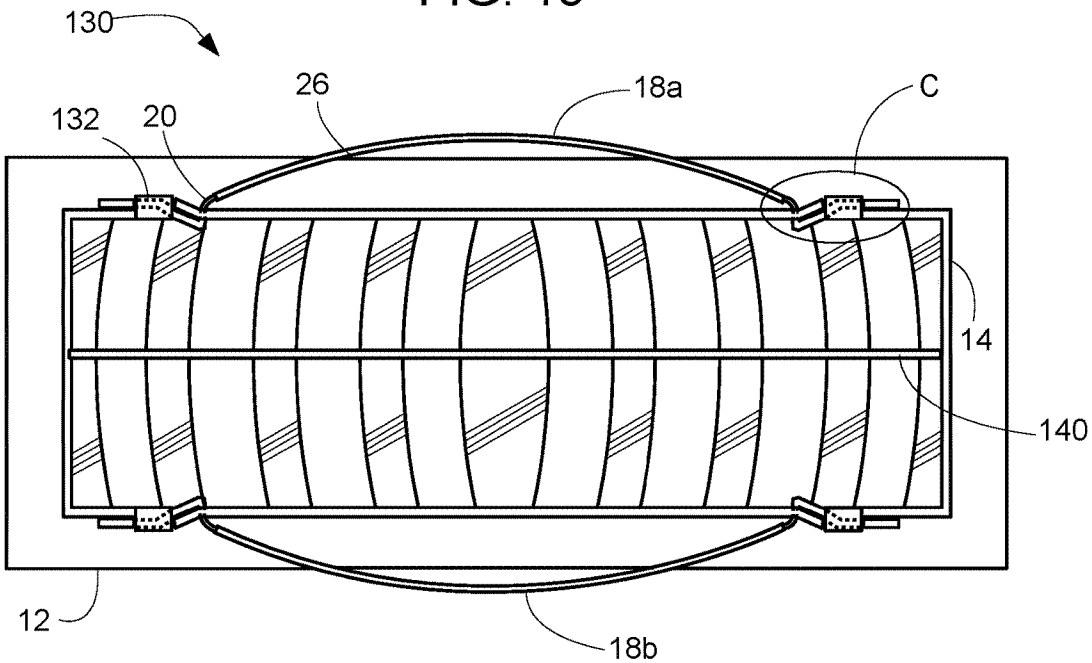
FIG. 13 shows a top view of a register vent having a crimped connection on the wire ends of a plurality of sidewall wings according to an exemplary embodiment of the present invention.
Figure 14:
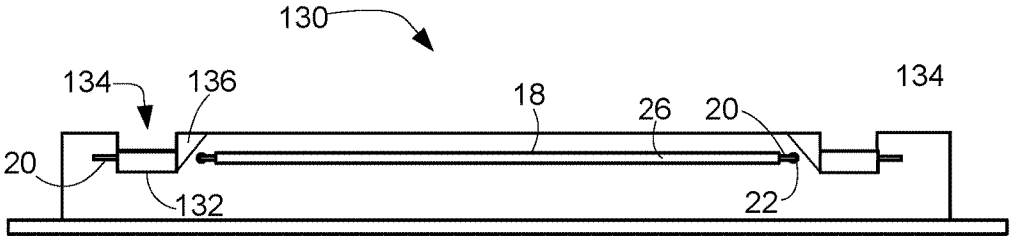
FIG. 14 illustrates a side view of the register vent of FIG. 13.

FIG. 13 shows a top view of a metal register vent 130 having a crimped connection on the wire 20 ends of a plurality of sidewall wings 18 according to an exemplary embodiment of the present invention. FIG. 14 illustrates a side view of the register vent 130 of FIG. 13 and FIG. 15 likewise illustrates an end view of the register vent 130 of FIG. 13. As shown, the wire 20 forming the first and second sidewalls 18*a,b* in this embodiment is crimped to the sidewalls 14 by folding over a tab 132 from a notched section 134 of the perpendicularly-extending sidewalls 14 on each end of the wire 20.

Figure 16:
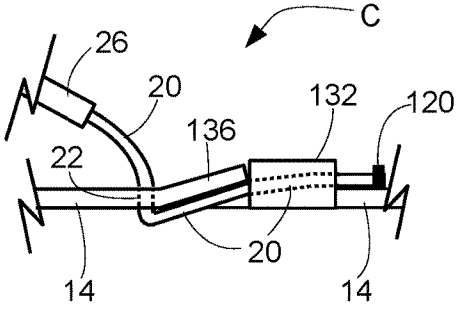

FIG. 16 illustrates a zoomed-in top view of the point of connection labelled as area C in FIG. 13. As illustrated, the spring-tempered wire 20 passes through a first hole 22*a* in the sidewall 14 to enter an inside area of the sidewall sleeve 14. The wire 20 is then run a short distance such a quarter of an inch along an angled section 136 of the sidewall 14. This angled section 136 is adjacent a notched out area 134 and the angled section 136 is bent outward such that it directs the wire 20 back towards the outside surface 138 of the sidewall 14. The wire 20 is then pinched between a tab 132 of the sidewall 14 that is folded down over the wire 20 and squished against the wire 20 to form a crimped joint. The end of the wire 20 in this embodiment runs a short distance passed the crimp joint of the folded tab 132 on the outer sidewall surface 138. Similar to the previous embodiment, in some embodiments, a stopper 120 is attached to the end of the wire 20 at this point to prevent it from being pulled through the crimp joint formed by the folded tab 132. Likewise, in some embodiments, the end of the wire 20 is attached to the outer surface of the sidewall 14 such as via any of the previously-described techniques of plastic or metal arc welding, glue or other adhesives.

Figure 15:
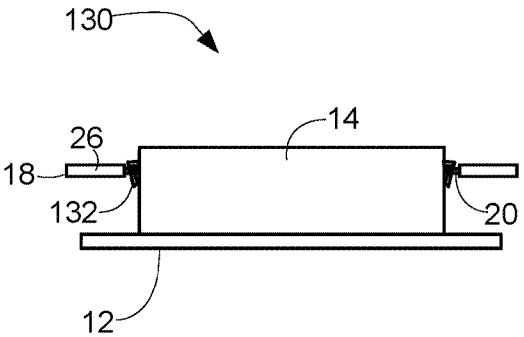
FIG. 15 illustrates an end view of the register vent of FIG. 13.
Figure 17:
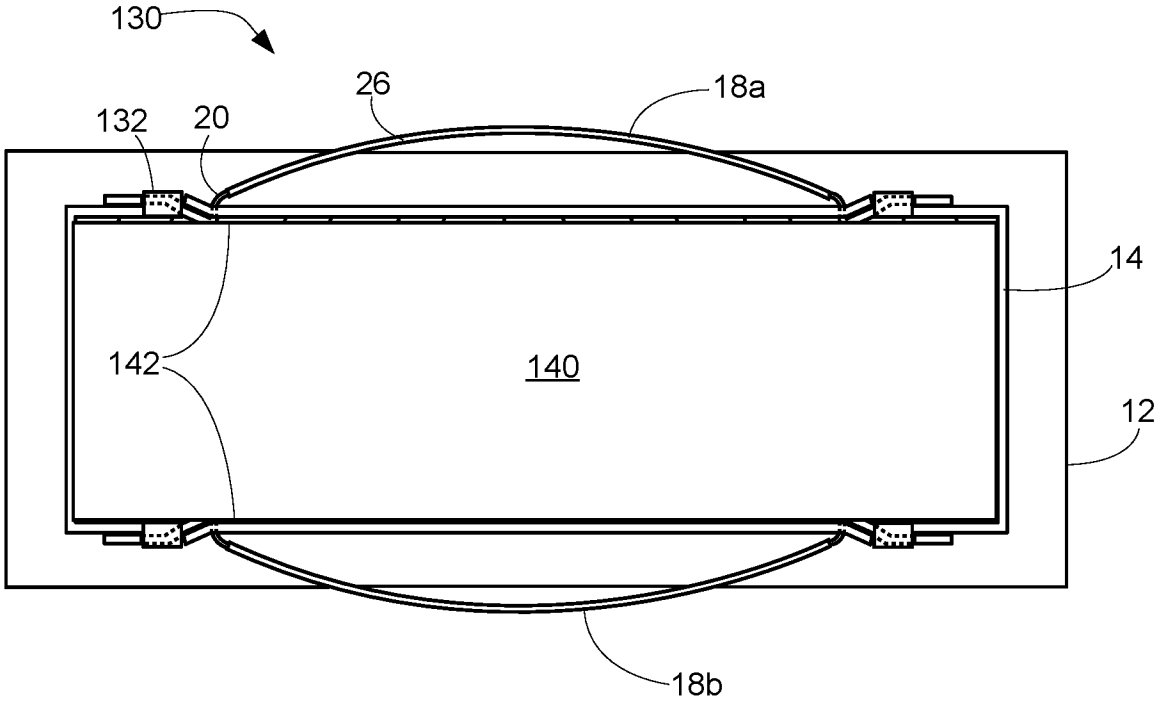
FIG. 17 shows a top view of the register vent of FIG. 13 when the damper plate is rotated such that it is perpendicular to the airflow and thereby blocks the airflow.

In the embodiment of FIGS. 13 to 15, the angled sidewall 136 is bent outward and the tabbed notch 132 is folded downward on the outside surface 138 of the sidewall 14 to pinch the wire 20 on the outside surface 138 of the register vent sidewall sleeve 14. Having the angled section 136 fold outward and the tab 132 likewise fold downward on the outside surface 138 is beneficial in some embodiments where the register vent 130 includes a rotating damper plate 140. In FIG. 13, the damper plate 140 is shown rotated such that it is parallel the airflow in an open position. However, when the damper plate 140 is rotated ninety degrees such that is perpendicular to the airflow and thereby blocks the airflow, it is beneficial to have the angled sidewalls 136 bending outwards and tab 132 folding outwards to avoid impacting or otherwise interfering with the edge 142 of the damper plate 140—see FIG. 17.

A method of manufacturing register vents 10, 90, 130 according to an exemplary embodiment may comprising converting an existing, prior art register vent that does not include bow-springs 18 to include one or more bow-springs 18. In an exemplary embodiment, the manufacturing process includes drilling one or more holes 22 in the vertical sidewalls 14 to accept the spring-tempered wire 20 of the bow-spring(s) 18. Each bow-spring 18 is formed by a length of high carbon steel wire 20 and includes a friction increasing means 26 on at least a center portion of the wire 20. The two ends of the wire 20 for a bow-spring 18 are inserted and then secured to a register vent sidewall 14 such that the wire 20 bows outwards from the sidewall 14 by about one inch to form a U-shaped wing 18. The process of securing the wire 20 ends may be done in some embodiments utilizing one of the above-described connection techniques such as:

- passing through a hole 22 in the sidewall 14 and then being secured with a plastic or metal weld 24 or other adhesive (FIG. 4);
- passing through a plurality of at least three holes 22*a,b,c* in the sidewall 14 on each end of the wire 20 such that the wire 20 is "stitched" through the sidewall 14 on each end (FIG. 12); or
- passing through a hole 22 and then crimped using a folded tab 132 notched out of the sidewall 14 (FIG. 16).

The process of attaching bow-springs 18 may be repeated for each sidewall 14 that is desired to include a bow-spring 18. In some embodiments, the register vent 10, 90, 130 is rectangular and two separate bow-springs 18*a,b* are respectively attached on each of the longer lengthwise sidewalls 14*a,c*.

The above manufacturing steps are not restricted to the exact order described, and, in other configurations, described steps may be omitted or other intermediate steps added. Furthermore, in some embodiments, a kit is sold comprising the bow-spring 18 wires 20 with preinstalled friction increasing means 26 along with instructions for an end-user to modify prior art register vents to include said bow-springs 18.

According to an exemplary embodiment, a vent register 10, 90, 130 includes a front plate 12 having a perforated section for allowing airflow through the front plate 12, and a plurality of sidewalls 14 perpendicularly extending from a side of the front plate 12 and forming a sleeve for insertion into an opening 54 of a ventilation duct. A first bow-spring 18*a* is attached to a first sidewall 14*a* of the plurality of sidewalls 14 and a second bow-spring 18*b* is attached to a second sidewall 14*c*, the second sidewall 14*c* being opposite the first sidewall 14*a*. The first and second bow-springs 18*a,b* are each respectively spring-tempered wires 20, the first bow-spring 18*a* being attached at both ends to the first sidewall 14*a*, and the second bow-spring 18*b* being attached at both ends to the second sidewall 14*c*. Each of the first and second bow-springs 18*a,b* thereby forms a U-shape wing respectively extending from the first and second sidewalls 14*a,c*. In some embodiments, the bow-springs 18 include friction increasing means 26 on at least a center portion for securing the register vent 10, 90, 130 in the opening 54.

Although the invention has been described in connection with preferred embodiments, it should be understood that various modifications, additions and alterations may be made to the invention by one skilled in the art without departing from the spirit and scope of the invention. For example, although the above-description description has focused on a register vent 10, 90, 130 for use in a ceiling, in other situations the same designs of register vents 10, 90, 130 can also be utilized in conjunction with wall-mounted register boxes 50 and also floor-mounted register boxes 50.

Figure 18:
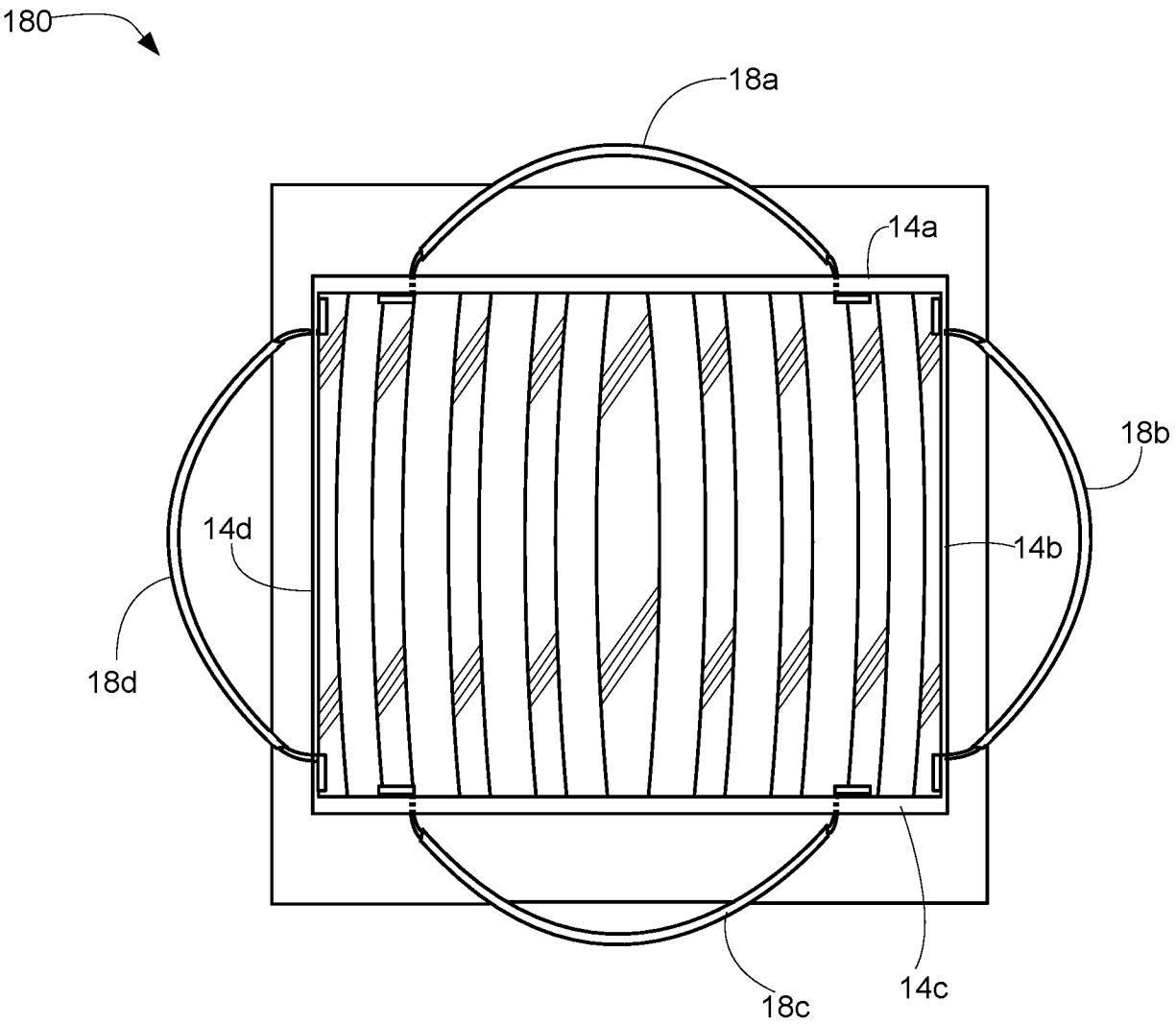
FIG. 18 illustrates a square register vent having a plurality of four bow-spring sidewall wings according to an exemplary embodiment of the present invention.

In yet another example modification, although two bow-springs 18*a,b* mounted on the longer-length sidewalls 14*a,c* of a substantially rectangular register vent 10, 90, 130 is illustrated above in some beneficial embodiments, other embodiments are also possible. For instance, a register vent 10, 90, 130 in some embodiments may have a single bow-spring 18 on a single one of the sidewalls 14. Such a design may be of particular benefit to reduce costs for wall and floor-based register vents 10, 90, 130 that do not need as much frictional forces to be held in place. Likewise, more than two bow-springs 18 may be utilized such as illustrated in FIG. 18 where a square register vent 180 is secured utilizing a plurality of four bow-spring wings 18*a,b,c,d*. In the embodiment of FIG. 18, each of the four perpendicularly-extending sidewalls 14*a,b,c,d* includes its own bow-spring 18*a,b,c,d*.

Functions of single units may be separated into multiple units, or the functions of multiple units may be combined into a single unit. All combinations and permutations of the above described features and embodiments may be utilized in conjunction with the invention.

What is claimed is:

1. A vent register comprising:

a front plate having a perforated section for allowing airflow through the front plate;

a plurality of sidewalls perpendicularly extending from a side of the front plate and forming a sleeve for insertion into an opening of a ventilation duct;

a first bow-spring attached to a first sidewall of the plurality of sidewalls; and a friction increasing means on at least a center portion of the first bow-spring;

wherein the first bow-spring is a length of spring-tempered wire attached at both ends to the first sidewall such that the first bow-spring forms a U-shape wing along the first sidewall.

2. The vent register of claim 1, further comprising:

a second bow-spring attached to a second sidewall of the plurality of sidewalls, the second sidewall being opposite the first sidewall;

wherein the second bow-spring is a second length of spring-tempered wire attached at both ends to the second sidewall such that the second bow-spring forms a second U-shape wing along the second sidewall.

3. The vent register of claim 1, wherein the friction increasing means comprises a rubberized plastic wrap around the center portion of the length of spring-tempered wire forming the first-bow spring.

4. The vent register of claim 1, wherein:

the plurality of sidewalls perpendicularly extending from the side of the front plate including a plurality of two longer sidewalls and two shorter sidewalls thereby forming the sleeve being substantially rectangular in shape; and the first bow-spring is attached to one of the two longer sidewalls.

5. The vent register of claim 1, wherein the first bow-spring is attached to the first sidewall at least by a plastic weld on each end of the first bow-spring.

6. The vent register of claim 1, wherein the first bow-spring is attached to the first sidewall at least by passing the length of wire forming the first bow-spring through the first sidewall via a plurality of at least three holes on each end of the first bow-spring.

7. The vent register of claim 1, wherein the first bow-spring is attached to the first sidewall at least by crimping the length of wire forming the first bow-spring between a folded-over notched section of the first sidewall on each end of the first bow-spring.

8. A vent register comprising:

a front plate having a perforated section for allowing airflow through the front plate;

a plurality of sidewalls perpendicularly extending from a side of the front plate and forming a sleeve for insertion into an opening of a ventilation duct;

a first bow-spring attached to a first sidewall of the plurality of sidewalls, wherein the first bow-spring is a length of spring-tempered wire attached at both ends to the first sidewall such that the first bow-spring forms a U-shape wing along the first sidewall;

a second bow-spring attached to a second sidewall of the plurality of sidewalls, the second sidewall being opposite the first sidewall, wherein the second bow-spring is a second length of spring-tempered wire attached at both ends to the second sidewall such that the second bow-spring forms a second U-shape wing along the second sidewall;

a first friction increasing means on at least a center portion of the first bow-spring; and a second friction increasing means on at least a center portion of the second bow-spring.

9. The vent register of claim 8, wherein the first friction increasing means and the second friction increasing means respectively comprise rubberized plastic wraps around spring-tempered wires forming the first bow-spring and the second bow-spring.

10. The vent register of claim 8, wherein:

the plurality of sidewalls perpendicularly extending from the side of the front plate including a plurality of two longer sidewalls and two shorter sidewalls thereby forming the sleeve being substantially rectangular in shape; and the first bow-spring is attached to one of the two longer sidewalls.

11. The vent register of claim 8, wherein the first bow-spring is attached to the first sidewall at least by a plastic weld on each end of the first bow-spring.

12. The vent register of claim 8, wherein the first bow-spring is attached to the first sidewall at least by passing the length of wire forming the first bow-spring through the first sidewall via a plurality of at least three holes on each end of the first bow-spring.

13. The vent register of claim 8, wherein the first bow-spring is attached to the first sidewall at least by crimping the length of wire forming the first bow-spring between a folded-over notched section of the first sidewall on each end of the first bow-spring.

14. A vent register comprising:

a front plate having a perforated section for allowing airflow through the front plate;

a plurality of sidewalls perpendicularly extending from a side of the front plate and forming a sleeve for insertion into an opening of a ventilation duct; and a first bow-spring attached to a first sidewall of the plurality of sidewalls;

wherein the first bow-spring is a length of spring-tempered wire attached at both ends to the first sidewall such that the first bow-spring forms a U-shape wing along the first sidewall; and the first bow-spring is attached to the first sidewall at least by crimping the length of wire forming the first bow-spring between a folded-over notched section of the first sidewall on each end of the first bow-spring.

15. The vent register of claim 14, further comprising a rubberized plastic wrap around a portion of the length of spring-tempered wire forming the first-bow spring.

16. The vent register of claim 14, further comprising:

a second bow-spring attached to a second sidewall of the plurality of sidewalls, the second sidewall being opposite the first sidewall, wherein the second bow-spring is a second length of spring-tempered wire attached at both ends to the second sidewall such that the second bow-spring forms a second U-shape wing along the second sidewall;

a first rubberized plastic wrap around a portion of the length of spring-tempered wire forming the first-bow spring; and a second rubberized plastic wrap around a portion of the length of spring-tempered wire forming the first-bow spring.

17. The vent register of claim 14, wherein:

the plurality of sidewalls perpendicularly extending from the side of the front plate including a plurality of two longer sidewalls and two shorter sidewalls thereby forming the sleeve being substantially rectangular in shape; and the first bow-spring is attached to one of the two longer sidewalls.

* * * * *